United States Patent [19]

Lehtinen

[11] Patent Number: 4,506,456

[45] Date of Patent: Mar. 26, 1985

[54] METHOD FOR DRYING A POROUS WEB IN AN EXTENDED NIP PRESS

[75] Inventor: Jukka Lehtinen, Tampere, Finland

[73] Assignee: Oy Tampella AB, Tampere, Finland

[21] Appl. No.: 475,840

[22] Filed: Mar. 16, 1983

[30] Foreign Application Priority Data

Apr. 6, 1982 [FI] Finland ..... 821207

[51] Int. Cl.[3] ..... F26B 3/20

[52] U.S. Cl. ..... 34/12; 34/14; 34/41; 34/70; 34/73; 34/162

[58] Field of Search ..... 34/9, 71, 95, 155, 162, 34/216, 209, 73, 75, 12, 14, 18, 41, 70

[56] References Cited

U.S. PATENT DOCUMENTS

| | | | |
|---|---|---|---|
| 4,106,209 | 8/1978 | Brown | 34/23 |
| 4,112,586 | 9/1978 | Lehtinen | 34/71 |
| 4,339,619 | 8/1983 | Martin | 34/162 |

*Primary Examiner*—Larry I. Schwartz
*Attorney, Agent, or Firm*—Ladas & Parry

[57] ABSTRACT

A method for drying a porous web, according to which method the wet web is passed onto at least one drying felt, the web and the drying felt are subjected to an air removal treatment, and the web and the drying felt are passed between two surface elements which are impermeable to liquid and form an extended press zone in which the web is subjected to a pressing effect from both sides. Before the press zone the wet web is heated to a temperature of at least nearly 100° C., and in the press zone the drying felt is kept at a temperature lower than the temperature of the wet web, so that a lower pressure is produced in the drying felt, and the high temperature of the water in the web causes an explosive evaporation and transfer of water from the web into the felt.

9 Claims, 3 Drawing Figures

FIG. 1
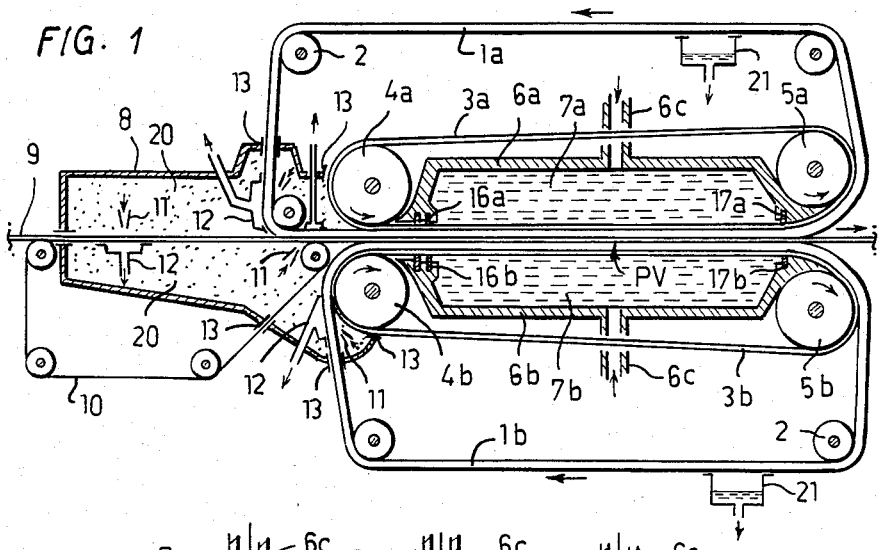
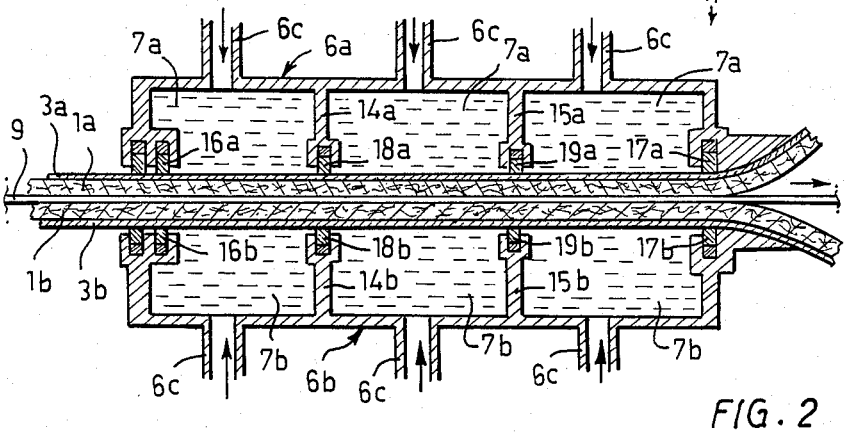
FIG. 2
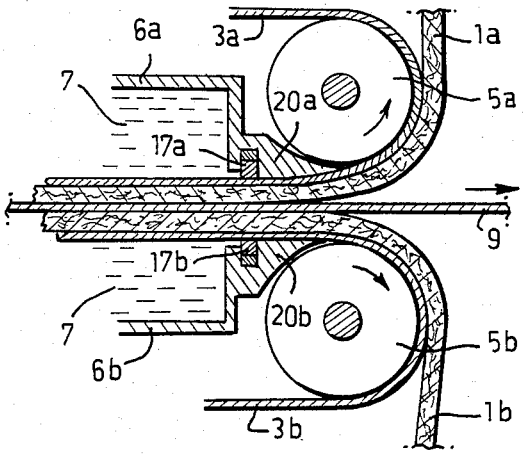
FIG. 3

METHOD FOR DRYING A POROUS WEB IN AN EXTENDED NIP PRESS

This invention relates to a method for drying a porous web, such as a paper or a cardboard web, according to which method the wet web is passed onto at least one drying felt or transporting means, the web and the drying felt are subjected to an air removal treatment, the web and the drying felt or transporting means are passed in between two surface elements which are impermeable to liquid and which form an extended press zone, in the press zone the web is subjected to a pressing effect from both sides, by both surface elements, and a partial vacuum is produced in the drying felt or transporting means for the duration of the pressing effect on the web.

It is known from paper and cardboard machines that dewatering can be accelerated and augmented in the press section both by heating the wet web before it enters the press nip and by keeping the drying felt or transporting means, or felt, or felts adjacent to the web under a partial vacuum during the pressing action.

Heating of the web prior to the pressing operation has been used in industrial production only in connection with conventional presses consisting of roll nips (e.g., Finnish Patent Application Nos. 761,398, 763,434, 770,538), although small-scale preheating has been projected to be used also with a special extended nip press method (Finnish Patent Application No. 802,106).

It is common practice in the industry to have the drying felt or transporting means under a partial vacuum in the press nip, by using a perforated press roll and a suction box within the roll. By contrast, in extended nip presses the use of a drying felt or transporting means kept under a partial vacuum during the pressing operation has only rarely been contemplated. Such a plan is described in said Finnish Patent Application No. 802,106 in which, however, a special diaphragm having small pores and impregnated with water is used between the mat subjected to a partial vacuum and the web, and in the U.S. Pat. No. 3,293,121. The reason for the limited utilization in extended nip presses of the improved water sucking capability of a drying felt operating under a partial vacuum may be that it is structurally difficult to implement the special features required for maintaining said partial vacuum.

The improved transfer of water during the pressing operation from the web to the drying felt, caused by the heating of the wet web prior to the press nip, is mainly due to the lower viscosity of the higher temperature water in the web. Only if the temperature of the web before the press is raised to a very high level, for example, up to 100° C., other phenomena assisting in the removal of water will also be involved. At higher temperatures and moisture contents the fibres of the web soften and bend. These deformations may cause constrictions in the internal voids of the fibres and express water. At the same time the deformations may cause slots and passages to open, which facilitates the discharge of water. The higher temperature of the fibres also causes increased capillary forces within the fibres. These forces tend to flatten the fibres, and thus water is expressed.

A particularly important factor to be considered in connection with raising the web temperature before pressing is the effect of such a raised temperature on the final qualitative properties of the web. It is commonly known that the strength properties of the web will be the better, the earlier the temperature of the web is raised during the drying process, and the higher the temperature will be raised. If this, moreover, takes place in connection with a pressing action in the z-direction, the results will be especially notable. The improved final strength properties will in this case mainly be due to the softening and the mutual deformation of the moist, heated fibres. In this way large interfibre contact areas will be formed. The simultaneous pressing effect in the z-direction will, of course, also be a contributing factor in this connection. At high temperatures and moisture contents, hemicelluloses can also soften and flow. These hemicelluloses form bonds between the fibres.

The partial vacuum in the felt clearly increases the pressure forces which tend to force water from the web in the direction into the drying felt. In practice, however, in a conventional roll press the main function of the felt, maintained at a partial vacuum by means of suction boxes, in improving dewatering has been to retard so-called rewetting. This rewetting comprises the transfer of water from the felt back to the web after the tightest part of the nip has been passed.

The object of this invention is to provide a method by means of which the extended nip pressing of a wet, continuously moving, porous web is caused to take place, on one hand, so that the web will be gotten from the press zone dryer than normally due to the fact that the transfer of water from the web into the drying felt has been facilitated, and, on the other hand, so that, as far as a paper or a cardboard web is concerned, the final strength properties of the web will be improved due to the fact that the extended nip pressing takes place at high web temperatures and moisture contents. This object is achieved by means of the method according to the invention, which method is characterized in that the wet web is heated before the press zone to a temperature of at least close to 100° C., and the drying felt is in the press zone kept at a temperature lower than the temperature of the web.

By means of the method according to the invention extended nip pressing can be carried out under such conditions that the above mentioned factors accelerating the transfer of the water from the web to the felt, i.e. the lower viscosity of the water due to the higher temperature, and the partial vacuum in the drying felt, can both be realized simultaneously. Because the wet web enters the press zone at a temperature of close to 100° C., being carried on a felt pressing said web, and because the pressure in the pores of the felt at the beginning of the press zone can be reduced to a very low level and kept at that low level, water is expressed from the web to the felt by means of one more mechanism, which is possible only under the above described conditions of the invention. Namely, the water in the felt at a temperature of nearly 100° C. is partly evaporated explosively when the pressure in the pores of the drying felt abruptly drops. Due to these explosions, water will be forced into the felt more quickly than normally. At the same time the web, however, does not disintegrate because the surface elements compress it between themselves from both sides with a high pressing force. The method according to the invention is thus based on the fact that the high temperature of the water in the inner parts of the web causes an explosive evaporation of the water when a partial vacuum is developed in the drying felt, whereby water is moved from the web to the drying felt at a high velocity.

If a high transfer rate for the transmission of water from the web to the drying felt is desired, it is preferable to keep the temperature of the pressing mediums acting on the surface elements in the range 0° to 75° C.

When it is desired to obtain advantageous deformation between the fibres or the chips within a paper, cardboard, or hard-board web, as well as advantageous softening of the organic fibre materials in view of the final strength properties, the pressure of the pressing mediums acting on the surface elements should preferably be kept within the range 75° to 100° C.

The invention will be described in more detail in the following, referring to the accompanying drawings, in which:

FIG. 1 illustrates the principle of the method according to the invention as applied to an extended nip band press, FIG. 2 is an enlarged vertical section of the press in the direction of movement of the web, and FIG. 3 is a vertical section of the exit end of the press.

The press shown in FIG. 1 of the drawings includes two endless drying felts 1*a* and 1*b*, which are passed around turning rolls 2, so that the felts run parallel to each other over a certain distance. Inside each drying felt runs an endless band 3*a* and 3*b*, respectively, which is impermeable to liquid and has reasonably good heat conducting properties, and is passed around turning rolls 4*a* and 5*a*, and 4*b* and 5*b*, respectively, so that the bands run parallel to each other over said distance of the felts, while being pressed against the outsides of the felts.

Inside each band is mounted a pressure chamber 6*a* and 6*b*, respectively. These are sealed against the bands and provided with inlets 6*c* for the pressure mediums 7*a*, 7*b*. The pressure chambers are open towards the bands so that an extended press zone PV is formed over this length of the bands. The pressure medium in this embodiment is water, and the same pressure is maintained in both pressure chambers. This is preferably achieved by connecting the chambers to each other with a pipe.

On the inlet side of the drying felts is mounted an air removal device 8, acting on both sides of the wet web 9 to be fed into the press zone. An endless auxiliary wire 10 is arranged for the web. Inside the air removal device, blowing means are installed for the web and for both felts. These blowing means comprises nozzles 11 for blowing steam into the web, and a suction box 12 on the opposite side of the sucking out a mixture of steam and air.

The air removal device is kept filled with steam 20 having a pressure somewhat higher than the atmospheric pressure on the outside, so that no air can enter via the seal clearances 13 of the air removal device, as some steam is continuously leaking out through those seal clearances.

The extended nip press operates in the following manner:

The wet web 9 is fed on the auxiliary wire 10 into the air removal device 8. In said device, air is removed from the web and the felts 1*a*, 1*b* by means of the nozzles 11 and the suction boxes 12, so that only about 3 to 10% of the original air remains in the web and the felts.

The web heats up in the air removal device due to the steam present therein, and goes in between the felts 1*a*, 1*b* at a temperature of about 100° C. The innermost parts of the thick fibres have not quite reached this temperature during the pass through the air removal device, although the surface layers may have reached the temperature of the condensing steam. The final average temperature of the fibres and the water can, however, be made to approach 100° C. by extending the duration of stay of the web in the steam in the air removal device. Because it is desirable to raise the temperature of the web to a high value, usually close to 100° C., while it is not desirable to warm the felts to a very high temperature, it is obvious that the air removal device should be constructed so that the felts will traverse it in a very short time, but the web in a much longer time.

From the air removal device 8, the felts and the web between them pass into the nip formed between the bands 3*a*, 3*b*. After the nip, the bands and the felts, and the web between them, enter the press zone PV created between the pressure chambers 6*a*, 6*b*. If the temperature of the pressure mediums 7*a*, 7*b* is at a suitable low level, for example 15° to 90° C., the steam entrained in the pores of the felts from the air removal device will condense on the surfaces of the bands 3*a* and 3*b* facing the felts, at the latest as the felts enter the region of the pressure chambers. A portion of this steam may already have condensed in advance on said surfaces due to the fact that the bands leave the air removal device probably at a temperature of somewhat less than 100° C. The average temperature of these bands 3*a* and 3*b*, as they enter the press zone PV, can be somewhat regulated by varying the distance through which the bands 3*a* and 3*b* travel in the steam space 20 of the air removal device 8.

In the region of the press zone the bands are cooled by the pressure mediums 7*a*, 7*b*. Steam then condenses from the pores of the felts onto the surfaces of the bands, and the pressure in the pores of the felts drops. Water now evaporates from the outer surfaces of the web, which are at a temperature of nearly 100° C. This steam passes through the felts to condense onto the bands. As this occurs, however, the vapour pressure of the water contained in the inner parts of the web, which pressure typically is nearly 103 kPa, is much higher than the pressure prevailing in the felts, which typically is less than 50 kPa. Therefore, the water in the inner parts of the web evaporates explosively, forcing water from the web into the felts. At the same time the web is also subjected to a conventional pressing action as the high pressure of the pressure mediums 7*a*, 7*b*, which is typically between 1 and 4 MPa, presses on the felts from the outside, and the web is compressed between these felts.

Difficulties are often encountered in press nips due to crushing of the web if too wet a web is quickly subjected to too high a pressing action. Therefore, this should be taken into account also in an extended nip press. The press zone PV confined by the pressure chambers 6*a*,6*b* can be divided into two or more sub-zones by using partitions 14*a*, 14*b*, 15*a* and 15*b* (FIG. 2). It is obvious that the pressure of the pressure medium 7*a*, 7*b* in each of the sub-zones so formed must be the same above and below the bands. The pressure medium fluid should probably be fed, 6*c*, and its pressure regulated, separately for each sub-zone.

In order to prevent excessive leakage of the pressure medium from the pressure chambers 6*a*, 6*b*, seals 16*a*, 16*b*, 17*a*, 17*b* should be installed between the inlet and outlet edges of the pressure chambers and the bands 3*a*, 3*b*. These seals must be somewhat flexible in the vertical direction of FIG. 1 because the thickness and the elasticity of the sandwich formed by the bands, the felts, and the web varies with respect to time and location. Suitable flexible seal designs are available. Two or more seal strips in series can be used for reducing leaks, as shown in FIG. 2, at the seals 16*a*, 16*b* at the inlet edges of the pressure chambers.

It may also be necessary to use seals 18*a*, 18*b*, and 19*a*, 19*b*, respectively, between the various sub-zones inside the pressure chambers 6*a* and 6*b*. These seals may be similar, and similarly constructed, as the seals at the inlet and outlet edges of the pressure chambers.

At the sides of the machine, the leaking of pressure mediums from the pressure chambers is limited by means of similar seals 16*a*, 16*b*, between which the sandwich formed by the bands, the felts, and the web slides.

As the felts and the web leave the press zone at the seal pair 17*a* and 17*b*, the pressing effect on the web ceases. Rewetting immediately commences, whereby water is transferred from the felts back into the web. In order to prevent this, the felts must be separated from the web as quickly as possible. A quick separation is effected by minimizing the number and width of the seal strips in series in the seals 17*a* and 17*b*—preferably to one single, narrow seal strip in each pressure chamber. As the bands pass the seals 17*a* and 17*b*, the bands and the felts contacting them must be separated immediately because the felts must not contact the web any longer than is necessary.

Upon turning the bands 3*a* and 3*b* to have them depart from each other as quickly as possible, a difficulty arises in bending these bands, however. Most band materials, namely, fatique in repeated strong bending.

If the bands 3*a* and 3*b* are made of steel, they may, as is well known, be stressed to a certain limiting stress practically an infinite number of times. On this basis the radii of the turning rolls 4*a*, 4*b*, 5*a* and 5*b* are determined. The steel bands must move on from the seals 17*a* and 17*b*, not bending to a smaller radius. Therefore, suitably curved sliding shoes 20*a* and 20*b* may be installed between these seals and the turning rolls 5*a* and 5*b*, as shown in FIG. 3. The turning rolls 5*a* and 5*b* are then located at a somewhat greater distance from each other.

If the bands 3*a* and 3*b* are made of steel, sliding shoes, such as 20*a* and 20*b*, must be installed also at the inlet nip of the press zone where the bands run from the turning rolls 4*a* and 4*b* to the seals 16*a* and 16*b*. If this is not done, the steel bands will be bent at the seals 16*a* and 16*b* to a smaller radius than the radius of the turning rolls 4*a* and 4*b*.

The apparatus as described requires auxiliary devices for continuous operation, of course. These include, for example, high pressure water pumps and pressure regulators by means of which pressing medium at the desired pressure is continuously pumped into the pressure chambers. Also drying and conditioning devices 21 for the felts, known per se, (FIG. 1) are required. In these devices water transferred from the web to the felts is removed. It is obvious that guides, stretchers, and drives for the felts and bands must also be provided by means and devices known per se.

The drawing and description relating thereto are only intended to illustrate the idea of the invention. In its details the method according to the invention may vary considerably within the scope of the claims. Thus, in its simplest form, the method can be realized by using one drying felt only. Although both surface elements, between which the extended press zone is formed, as shown in the drawings as bands 3*a*, 3*b*, it is possible to use as one surface element a press roll having a solid shell, and as the other surface element a band or a press roll having a flexible shell, or a sliding shoe. By these means an extended press zone is created, in which the wet web can be subjected to the here previously described heating and pressing action.

What I claim is:

1. A method for drying a porous web, such as a paper and a cardboard web carried by at least one transporting means comprising: removing air from said web and said transporting means; passing said web and said transporting means between at least two impermeable to liquid surface elements defining an extended press zone, said surface elements being pressed toward each other in said press zone by means of pressure medium acting on them; subjecting surfaces of said web to a pressing effect by said surface elements; and keeping said transporting means in said press zone at a temperature lower than a temperature of said web and producing of a partial vacuum in said transporting means for duration of said pressing effect on said web;

and heating said web before said press zone to a temperature in an area of 100° C.

2. The method according to claim 1 wherein said liquid is transferred from said web into said transporting means by means of liquid transfer and evaporation.

3. The method according to claim 1 wherein said transporting means is a drying felt.

4. A method according to claim 1, wherein water is used as the pressure mediums.

5. A method according to claim 1, wherein metal sheets or bands are used as the surface elements impermeable to liquid and having good heat conducting properties.

6. A method according to claim 1, wherein said web is passed between two transporting means, and wherein both transporting means are kept at a lower temperature than the temperature of said wet web.

7. A method according to claim 1, wherein said pressure mediums are kept at a temperature of 0° to 75° C.

8. A method according to claim 1, wherein said pressure mediums are kept at a temperature of 75° to 100° C.

9. A method according to claim 7, wherein said pressure mediums are kept under pressures and/or temperatures arranged stepwise in the direction of movement of said web.

* * * * *